United States Patent [19]

Pearson

[11] Patent Number: 4,976,357

[45] **Date of Patent: * Dec. 11, 1990**

[54] ARTICLE DISPLAY

[76] Inventor: Robert C. Pearson, 7000 Bryan Dairy Rd. Bldg. B, Suite 1, Clearwater, Fla. 34647

[ * ] Notice: The portion of the term of this patent subsequent to Nov. 29, 2005 has been disclaimed.

[21] Appl. No.: 136,373

[22] Filed: Dec. 22, 1987

Related U.S. Application Data

[63] Continuation-in-part of Ser. No. 928,469, Nov. 7, 1986, Pat. No. 4,787,520, which is a continuation-in-part of Ser. No. 791,356, Oct. 25, 1985, abandoned.

[51] Int. Cl.[5] ..... A47F 7/00

[52] U.S. Cl. ..... 211/13; 211/189; 211/107; 248/225.1

[58] Field of Search ..... 211/13, 60.1, 189, 206, 211/191, 87, 94.5, 107; 248/DIG. 2, 222.2, 225.1, 224.2

[56] References Cited

U.S. PATENT DOCUMENTS

| | | | |
|---|---|---|---|
| 1,219,685 | 3/1917 | Wall | 248/DIG. 2 |
| 1,710,847 | 4/1929 | Thursby | 248/DIG. 2 |
| 2,623,722 | 12/1952 | Glunt et al. | 248/DIG. 2 |
| 2,656,917 | 10/1953 | Hollis | 248/DIG. 2 |
| 3,817,392 | 6/1974 | Bloch | 211/13 |
| 3,895,718 | 7/1975 | Seiller | 211/13 |
| 4,204,602 | 5/1980 | Dunchock | 211/13 |
| 4,509,648 | 4/1985 | Govang et al. | 211/87 X |
| 4,512,481 | 4/1985 | Thalenfeld | 248/222.2 X |
| 4,558,788 | 12/1985 | Grothaus | 211/13 |
| 4,694,965 | 9/1987 | Parnell | 211/87 |
| 4,708,311 | 11/1987 | Clausen et al. | 211/87 X |
| 4,718,562 | 1/1988 | Winkler, Jr. | 211/87 X |
| 4,724,966 | 2/1988 | Benaksas | 211/87 X |
| 4,726,554 | 2/1988 | Sorrell | 211/87 X |

*Primary Examiner*—Blair M. Johnson

*Attorney, Agent, or Firm*—Frijouf, Rust & Pyle

[57] ABSTRACT

A slat board hanger is used with a slat board having a L-shaped receiving groove and an elongate post for displaying articles. The slat board hanger comprises a hanger member including a first portion, a second portion and an intermediate portion. Each of the first and second portions of the hanger member defines a first tongue and a second tongue, respectively. The intermediate portion of the hanger member defines a supporting means. The first and second tongues of the hanger member are spaced apart to provide an opening to permit the supporting means of the hanger member to releasing grip in use the elongate post. The supporting means comprises a semicircle portion having two sidewalls leading from the semicircle portion thereby defining the opening formed by the spaced apart first and second tongues of the hanger member to permit the semicircle portion in use to grippingly receive and support the elongate post. Each tongue is adapted to be releasably secured within the L-shaped receiving groove by means of engagement with the L-shaped receiving groove of the slat board such that in use each the first and second tongues securely supports the hanger member on the slat board thereby enabling the elongate post to be securely supported by the supporting means of the hanger member such that articles may be displayed on the elongate post.

5 Claims, 9 Drawing Sheets

ARTICLE DISPLAY

RELATED APPLICATIONS

This application is a continuation-in-part of Ser. No. 928,469 filed Nov. 7, 1986, now U.S. Pat. No. 4,787,520 which is a continuation-in-part of Ser. No. 791,356 filed Oct. 25, 1985, now abandoned, both of which are incorporated by reference as if fully set forth herein.

BACKGROUND OF THE INVENTION

1. Field of the Invention

This invention relates to an article display utilizing a slat board hanger in cooperation with a slat board and an elongate post for supporting and displaying eyeglasses and other items. More specifically it relates to a slat board hanger for use with a slat board having a L-shaped receiving groove and is designed to support an elongate post and optionally at least one display tray for displaying eyeglasses or the like along a horizontal plane at an angle offering greater visual appeal to potential customers.

2. Summary of the Invention

Many of the display trays used for exhibiting eyeglasses have supporting trays glued onto supporting posts. These do not offer much flexibility in arrangement of displays. Moreover the trays neither exhibit the eyeglasses at an attractive angle nor display a plurality of eyeglasses along a horizontal plane.

It is an objective of this invention to provide a slat board hanger member releasably secured to a slat board for supporting an elongate post for the positioning of display trays for eyeglasses and other items which trays may be easily clipped or fastened onto elongate post.

It is a further object of this invention to provide such hanger members which may also be moved within a L-shaped receiving groove of the slat board.

It is a further object of this invention to provide an article display for displaying a plurality of articles in a horizontal plane without empty display trays or voids occurring as the article, such as eyeglasses, is removed from the article display.

It is a further object of this invention to provide an article display for a plurality of articles whereby as the articles displayed thereon are removed, a display tray may be removed from the article display to thereby maintain the article display in a filled condition.

It is a further object of this invention to provide an article display where each article displaying member or display tray is for one article and where the articles can be displayed along a horizontal plane and where each empty tray can be removed from those trays having an article displayed thereon.

It is a further object of this invention to provide an article display where each article displaying member or display tray is for one article and where the articles can be displayed along a horizontal plane such that the addition of more article display members or tray(s) is possible as more articles to be displayed become available for display thereby providing additional article display members in the filled article display.

It is a further object of this invention to provide a horizontal member with a grasping means where the portion of the grasping means which grippingly engages the circumference of the supporting post has a length and grip sufficient to support the lateral weight of the bridging members and articles placed thereon.

It is a further object of this invention to provide a horizontal member with a mortise and a tenon positioned at the first end and second end of the horizontal member, respectively, for enabling a releasable attachment and interconnection of a bridging tray having a mortise and a tenon positioned at the first and second end, respectively, by forming a mortise and tenon joint.

The foregoing has outlined some of the more pertinent objects of the present invention. These objects should be construed to be merely illustrative of some of the more pertinent features and application of the invention. Many other beneficial results can be obtained by applying the disclosed invention is a different manner or modifying the invention within the scope of the disclosure. Accordingly, other objects and a fuller understanding of the invention may be had by referring to the summary of the invention and the detailed description describing the preferred embodiment in addition to the scope of the invention defined by the claims taken in conjunctions with the accompanying drawings.

SUMMARY OF THE INVENTION

In accordance with the present invention a display tray for eyeglasses and other items has been designed which is easily clipped or fastened onto a supporting post having a preferred cylindrical cross-section of appropriate diameter so that an opening in the tray will allow the tray to slide to a partially circular opening having a diameter the same as the outside diameter of the post and provide a tight fit against the supporting post. Most importantly, the display tray provides support for additional display trays attached to it as disclosed below. Further, a hanger member has been designed support an elongate post having a preferred cylindrical cross-section of appropriate diameter so that an opening in the hanger member will provide a tight fit against the supported post. The tray and hanger member are made of a plastic material having sufficient resiliency so that there will be sufficient bending thereof to allow entry of the post into the opening of the tray or hanger member.

The present invention is defined by the appended claims with the specific embodiment shown in the attached drawings. For the purpose of summarizing the invention, the invention relates to an article display tray for cooperation with a base and a supporting post attached to the base with the post extending vertically relative to the base. A first bridging display tray includes a first end and a second end with a trough extending therebetween for positioning of at least one article to be displayed thereon from a plurality of articles to be displayed. A first and a second attachment means is positioned at the first end and the second end of the display tray wherein the first and second attachment means are a mortise and tenon, respectively. The article display tray comprises a horizontal member including a first portion, a second portion and a intermediate portion. Each of the first and second portions of the horizontal member defines a first and second trough, respectively, to enable in use the positioning of the article to be displayed thereon. The intermediate portion of the horizontal member defines a grasping means for releasingly gripping in use the supporting post to enable the horizontal member to be positioned along the vertical length of the supporting post. The first and second portions of the horizontal member are axially spaced apart to provide an opening to permit the grasping means of the horizontal member to grippingly receive the supporting post. The grasping means comprises a semicircle portion having two sidewalls leading from the semicircle portion thereby defining the opening formed by the axially spaced apart first and second portions of the horizontal member to permit the semicircle portion to grippingly receive the supporting post such that in use the first and the second troughs of the horizontal member are positioned substantially entirely in front of the supporting post. The horizontal member includes a first end and a second end. A first and a second fastening means are integrally formed and positioned at the first end and the second end of the horizontal member, respectively. The first and the second fastening means of the horizontal member is, preferably, a mortise and a tenon, respectively. The mortise and tenon of the horizontal member enable in use the releasable attachment and interconnection of one of the mortise and tenon of the bridging tray to one of the mortise and tenon positioned at one of the first and second ends of the horizontal member by forming a mortise and tenon joint between one end of the horizontal member and one end of the bridging tray. The resulting mortise and tenon joint between the horizontal member and bridging member enables the removal of the bridging tray as the final article displayed on the bridging tray is removed to enable the article display to remain filled with displayed articles.

In another embodiment of the invention the article display tray comprises a horizontal member including a first portion, a second portion and an intermediate portion. Each of the first and second portions of the horizontal member defines a first and second trough, respectively, to enable in use the positioning of an article to be displayed thereon. The intermediate portion of the horizontal member defines a grasping means for releasingly gripping in use a supporting post to enable said horizontal member to be positioned along the vertical length of said supporting post. The first and second portions of the horizontal member are axially spaced apart to provide an opening to permit the grasping means of the horizontal member to grippingly receive the supporting post. The grasping means comprises a semicircle portion having two sidewalls leading from the semicircle portion thereby defining the opening formed by the axially spaced apart first and second portions of the horizontal member to permit the semicircle portion to grippingly receive the supporting post such that in use the first and second troughs of the horizontal member are positioned substantially entirely in front of the supporting post. The horizontal member includes a first end and a second end. A first and a second fastening means is positioned at the first end and the second end of the horizontal member, respectively, wherein the first and the second fastening means are a mortise and a tenon, respectively. The mortise and tenon enable in use a releasable attachment and interconnection of the horizontal member to a bridging tray a having a first and a second end with a mortise and a tenon positioned at the first end and the second end, respectively, by forming a mortise and tenon joint between one end of the horizontal member and one end of the bridging tray to enable the removal of the bridging tray as the final article displayed on the bridging tray is removed to enable the article display to remain filled with displayed articles.

The mortise and tenon joint releasingly attaches and supportingly interconnects the bridging display tray to the horizontal member at the mortise and tenon joint. The mortise formed at the one of the first and second ends of the horizontal member is slidably and frictionally received into the tenon formed at one the of first and second ends of the bridging display tray of the plurality of bridging display trays to releasingly attach and supportingly interconnect the bridging display tray to the horizontal member at the mortise and tenon joint. The mortise and tenon joint enables the removal of one of the bridging display trays as one of the articles displayed from the plurality of articles displayed is removed.

The advantage of the horizontal member with an integral fastening means which cooperate with a bridging display tray having an attachment means is to form a joint which provides support to the bridging display tray by the horizontal member and also enables the removal of one of the bridging display trays from the article display as determined by the removal of displayed articles from the bridging display tray of the article display. Thus, as the articles positioned on the bridging display trays are sold or removed, the resulting empty bridging display tray(s) may be removed from the article display, thereby maintaining an article display filled with displayed articles. Additional bridging display trays can be attached to other bridging display trays previously attached and supported by the horizontal member. Further, an additional horizontal member(s) may be provided for to aid in supporting a chain of a plurality interconnecting bridging display trays extending between the two horizontal members. Preferably, the fastening means of the horizontal member and the attachment means of the bridging display trays are a tenon and mortise joint.

The invention may also be incorporated into a slat board hanger and article display. For purposes of summarizing the invention, the invention may be incorporated into an device for use with a slat board having a L-shaped recieving groove and an elongate post for displaying articles, comprising a hanger member including a first portion, a second portion and an intermediate portion. Each of the first and second portions of the hanger member defines a first tongue and a second tongue, respectively. Whereas the intermediate portion of the hanger member defines a supporting means. The first and second tongues of the hanger member are spaced apart to provide an opening to permit the supporting means of the hanger member to releasing grip in use the elongate post. The supporting means comprises a semicircle portion having two sidewalls leading from the semicircle portion thereby defining the opening formed by the spaced apart first and second tongues of the hanger member to permit the semicircle portion in use to grippingly receive and support the elongate post. Each tongue is adapted to be releasably secured within the L-shaped receiving groove by means of engagement with the L-shaped receiving groove of the slat board. Thus, in use each of the first and second tongues securely supports the hanger member on the slat board thereby enabling the elongate post to be securely supported by the supporting means of the hanger member such that articles may be displayed on the elongate post.

Preferably, each of the first and second tongues of the hanger member extend outwardly relative to the supporting means and along a longitudinal axis extending away from the supporting means. The outward extension of each tongue is at least as great as and is preferably greater than the spaced apart length of the opening created by the spaced apart first and second tongues. This configuration enhances support of the hanger member by the engagement of the outwardly extending first and second tongues along the L-shaped receiving groove of the slat board and also enhances the stability of the elongate post supported by the hanger member. Each of the first and second tongues of the hanger member includes a first end and a second end with each of the first ends being positioned proximate the supporting means. Each of the second ends of each of the first and second tongues may be biased such that each of the first ends of the first and second tongues is positioned in a plane different than the plane of the second ends of the first and second tongues. This enables the first ends and the second ends of the tongues to securely press against the forward and rearward wall, respectively, of the L-shaped groove of the slat board. The engagement of the first and second ends of the tongues of the hanger member against the front and rear wall, respectively, of the slat board groove essentially "locks" the hanger member at a positioned placed in the L-shaped receiving groove of the slat board thereby limiting sliding along the L-shaped groove of the slat board. This engagement further provides a secure wobble free attachment when the first and the second tongues are received into the L-shaped groove of the slat board which enhances the stability of the hanger member and elongate post supported by the hanger member. A wobble free hanger member is not loose within the L-shaped receiving groove.

Each of the tongues extend along a straight line in order to be received within the elongate L-shaped groove of the slat board. The orientation of the supporting means is preferably downwardly positioned toward the bottom of the slat board.

Preferably, the sidewalls of the supporting means extend perpendicularly relative to the longitudinal axis of the tongues to enable, in use, a perpendicular extension of the gripped and supported elongate post when the hanger member is positioned into the L-shaped groove of the slat board. The sidewalls of the supporting means may also be configured to extend at an angle less that perpendicular relative to the longitudinal axis of the tongues thereby enabling in use a less than perpendicular extension of the elongate post.

In a more specific embodiment of the invention for use with a slat board having a L-shaped receiving groove, an elongate post and at least one display tray for displaying at least one article thereon, secured to the elongate post, comprises a hanger member which includes a first portion, a second portion and an intermediate portion. Each of the first and second portions of the hanger member defines a first tongue and a second tongue, respectively. The intermediate portion of the hanger member defines a supporting means. The first and second tongues of the hanger member are spaced apart to provide an opening to permit the supporting means of the hanger member to releasing grip in use the elongate post to enable the positioning of at least one display tray along the length of the elongate post. The supporting means comprises a semicircle portion having two sidewalls leading from the semicircle portion thereby defining the opening formed by the spaced apart first and second tongues of the hanger member to permit the semicircle portion in use to grippingly receive and support the elongate post and at least one display tray secured thereto. Each of the tongues is adapted to be releasably secured within the L-shaped receiving groove by means of engagement with the L-shaped receiving groove such that in use each of the first and second tongues securely support the hanger member on the slat board to enable the elongate post to be securely supported by the supporting means of the hanger member and to further enable the elongate post to securely support the at least one display tray secured to the elongate post.

Preferably, each of the first and second tongues of the hanger member extend outwardly relative to the supporting means and along a longitudinal axis extending away from the supporting means. This configuration enhances support of the hanger member by the engagement of the outwardly extending first and second tongues along the elongated L-shaped receiving groove of the slat board. In a further embodiment, each of the first and second tongues defines a first section, a second section and a third section, with the first section extending upwardly relative to the supporting means, the second section extending perpendicularly relative to the first section and the third section extending perpendicularly relative to the second section to provide a L-shaped support member. Taken together this configuration presents a L-shaped support member which is releasably and securably received within the L-shaped receiving groove formed in the slat board. Preferably, each of the third sections of each of the first and second tongues includes a distal end which defines a tapered edge to enhance the ease of reception of the first and second tongues into the L-shaped groove when the tapered edge of the third section of the first and second tongues is inserted into the L-shaped groove of the slat board and pivotally positioned into a working position.

Another embodiment of the invention includes an article display for displaying a plurality of articles comprising a slat board having a L-shaped receiving groove and an elongate post having a first end and a second end. A plurality of display trays is used for displaying articles on. Each display tray of the plurality of display trays is fixed to the elongate post or is releasably secured to the elongate post such that the elongate post supports each display tray of the plurality of display trays secured to the elongate post. A hanger member includes a first portion, a second portion and an intermediate portion with each of the first and second portions of the hanger member defining a first tongue and a second tongue, respectively. The intermediate portion of the hanger member defines a supporting means for securely gripping the elongate post. The first and second tongues of the hanger member are spaced apart to provide an opening to permit the supporting means of the hanger member to releasing grip in use the elongate post to provide the supporting of at least one display tray along the length of the elongate post. The supporting means comprises a semicircle portion having two sidewalls leading from the semicircle portion thereby defining the opening formed by the first tongue being spaced apart from the second tongue of the hanger member to permit the semicircle portion in use to grippingly receive the elongate post thereby supporting the elongate post. Each of the tongues is adapted to be releasably secured within the L-shaped receiving groove of the slat board by means of engagement with the L-shaped receiving groove. The engagement of each of the tongues into the L-shaped groove of the slat board securely supports the hanger member on the slat board and enables the elongate post to be securely supported by the supporting means of the hanger member and further enables the elongate post to securely support each display tray of the plurality of display trays and at least one article for display positioned on each the display tray of the plurality of display trays.

Preferably, the sidewalls of the supporting means are inwardly biased to enhance the grip on the elongate post.

The article display is preferably displayed when the slat board is mounted in a plane and the supporting means is positioned to lie in a plane common to the plane of the slat board such that in use the elongate post extends outwardly relative to the plane of the slat board when positioned in the supporting means. Preferably, the slat board is positioned in use such that the L-shaped receiving grooves extend horizontally. The elongate post may further include at least one bend positioned between the first end and the second end of the elongate post such that in use the bend of the elongate post results in a change of direction of the elongate post relative to the plane of the slat board to enable the articles to be displayed at an inclined angle.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE DRAWINGS

Figure 1:
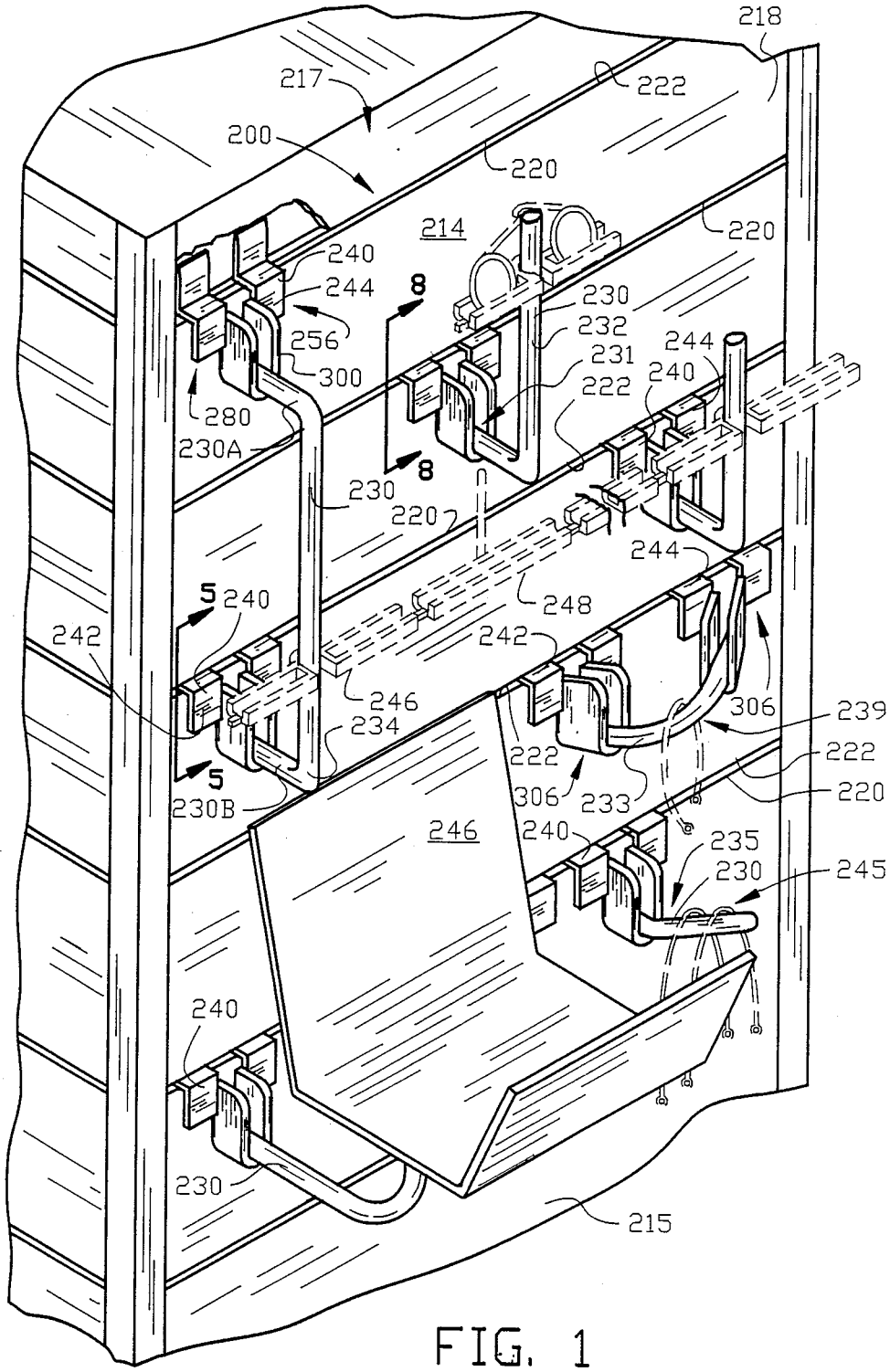
FIG. 1 is an isometric view of an article display with the slat board hanger of the invention.

FIG. 1 shows an isometric view of an slat board 214 article display 200 with the slat board hanger 240 in a working position 320 as positioned in the opening 222 of the L-shaped receiving groove 220. The L-shaped receiving groove 220 of slat board 214 supportingly receives the first tongue 256 and second tongue 280 of the hanger member 240. Positioned between the first tongue 256 and second tongue 280 is supporting means 300 which grasps and supports elongate post 230. Positioned on and supported by elongate post 230 are display trays designated generally as 246 and bridging display trays 248. A first 242 hanger member 240 and a second 244 hanger member may be positioned at different or in the same L-shaped receiving grooves on the slat board 214 to provide for different supporting arrangements of the elongated post as illustrated. Different shaped elongated posts 230 such as L-shaped 232, U-shaped 234 and arc shaped 233 further diversify the article display. The slat board 214 and hanger member 240 of the article display 200 are mounted in a plane 217. The supporting means 300 of the hanger member 240 is positioned to lie in a plane common to the plane 217 of the slat board 214 such that in use the elongate post 230 extends outwardly relative to plane 217 of the slat board when positioned in the supporting means 300. The elongate post 230 may further include a bend 235 positioned between the first end 230A and the second end 230B of the elongate post 230 such that in use the bend 235 of the elongate post 230 results in a change of direction of the elongate post 230 relative to the plane 217 of the slat board 214 to enable the articles to be displayed at an inclined angle 245.

Figure 2:
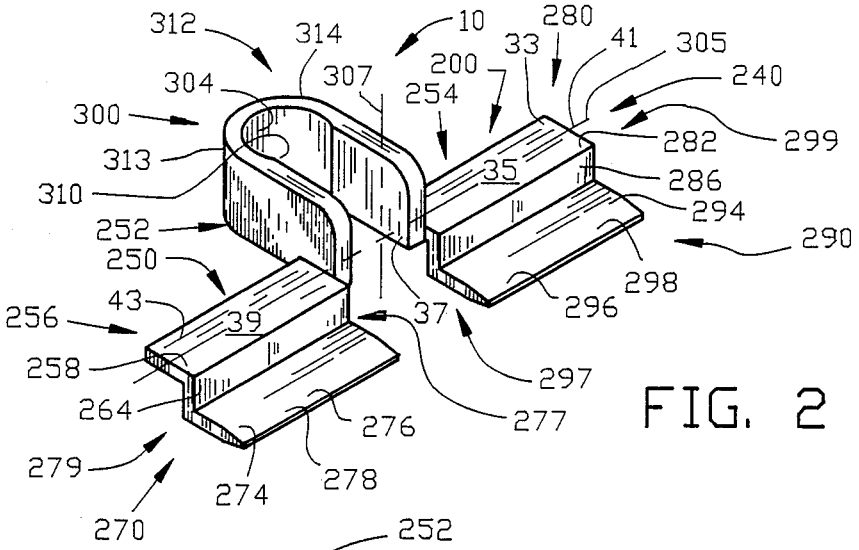
FIG. 2 is an isometric view of the slat board hanger.

FIG. 2 is an isometric view of the slat board hanger 240 which includes a first portion 250, a second portion 254 and an intermediate portion 252. Each of the first 250 and second 254 portions of the hanger member 240 defines a first tongue 256 and a second tongue 280, respectively. The intermediate portion 252 of the hanger member 240 defines a supporting means 300. The first 256 and second 280 tongues of the hanger 240 member are spaced apart to provide an opening to permit the supporting means 300 to releasing grip in use the elongate post 230. The supporting means 300 comprises a semicircle portion 312 having two side-walls 313,314 leading from the semicircle portion 312 thereby defining the opening 310 formed by the spaced apart first 256 and second 280 tongues of the hanger member 240 to permit the semicircle portion 312 in use to grippingly receive and support the elongate post 230.

Each tongue 256,280 is adapted to be releasably secured within the L-shaped receiving groove 220 of the slat board 214 by means of engagement with the L-shaped receiving groove 220 of the slat board 214 such that in use each the first 256 and second 280 tongues securely supports the hanger member 240 on the slat board 214. This enables the elongate post 230 to be securely supported by the supporting means 300 of the hanger member 240 such that articles 245, display tray 246 or the like may be positioned and displayed on the elongate post 230.

The first 256 and the second 280 tongues of the hanger member 240 extend outwardly relative to the supporting means 300 and along a longitudinal axis 305 extending away from the supporting means 300 to enhance support of the hanger member 240 by the engagement of the outwardly extending the first 256 and second 280 tongues along and within the opening 222 of L-shaped receiving groove 220 of the slat board 214. The sidewalls 313,314 of the supporting means 300 extend perpendicularly 307 relative to the longitudinal axis 305 of the tongues 256,280 thereby enabling in use a perpendicular extension of the elongate post gripped by the sidewalls. The sidewalls 313,314 of the supporting means 300 extend at an angle less than perpendicular relative to the longitudinal axis 305 of the tongues 256,280 to provide an offset support means 306 to enable in use a less than perpendicular extension 239 of the elongate post 230. That is, the sidewalls 313,314 may be offset, i.e. not perpendicular to the plane of the slat board, such that the gripped portion of the elongate post extends outwardly along the same plane as the offset sidewalls. The sidewalls of the supporting means are preferably perpendicular to the face of the slat board.

Each of the first 256 and second 280 tongues defines a first section 258,282, a second section 264,286 and a third section 274,294. Each first section 258,282 extends upwardly relative to the supporting means 300 when the hanger member is viewed in a working position 320. Each second section 264,286 extends rearwardly relative to the first section 258,282, respectively. Each third section 274,294 extends upwardly relative to the second section 264,286 i.e. in a plane parallel to each first section 258,282, respectively, to define a first 270 and second 290 L-shaped support member of the first 256 and second 280 tongues, respectively which is releasably and securably received within the L-shaped receiving groove formed in the slat board.

Figure 3:
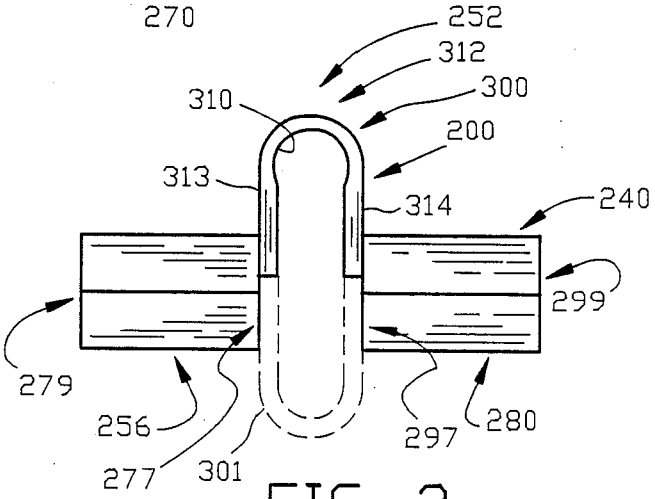
FIG. 3 is a front view of the slat board hanger.

FIG. 3 is a front view of the slat board hanger 240. The first 256 and second 280 tongues of the hanger member 240 each include a first end 277,297 and a second end 279,299, respectively, with each first end 277,297 being positioned proximate the supporting means 300. The supporting means 300 is preferably positioned such that the floor 304 of the supporting means 300 engages the gripped portion 231 of the elongate post 230 when the hanger member 240 is positioned in the L-shaped receiving groove 220 of the slat board 214. In the event the slat board is positioned such that the L-shaped receiving groove is inverted, hanger member 240 will still remain securely positioned to the slat board 214. It is preferred, however, that the floor 304 of the supporting means 300 be positioned to further support the elongate post 230. In this position the floor 304 is oriented toward the bottom 215 of the slat board 214. Where the L-shaped receiving groove 220 is inverted to resemble a 7-shaped receiving groove, the position of the supporting means 300 is preferably reversed to form the supporting means 301 as illustrated at FIG. 3 in phantom lines. The sidewalls 313,314 may be inwardly biased 315 to enhance the grip on the elongate post 230.

Figure 4:
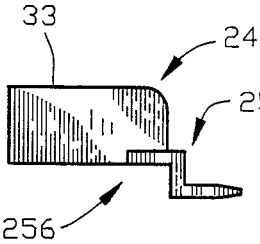
FIG. 4 is a side view of FIG. 3.
Figure 4A:
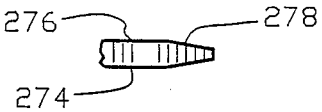
FIG. 4A is an enlarged view of a portion of FIG. 4.

FIGS. 4 and 4A illustrate in detail the third section 274 of the first tongue 256 of the hanger member 240. FIG. 2 illustrates in less detail the third section 294 of the second tongue 280. Each third section 274,294 of each the first 256 and second 280 tongues includes a distal end 276,296 defining a tapered edge 278,298 to enhance the ease of reception of the first 256 and second 280 tongues into the L-shaped groove when the tapered edge 278,298 of each third section 274,294 is inserted into the L-shaped groove 220 of the slat board 214 and pivotally positioned into a working position 320.

Figure 5:
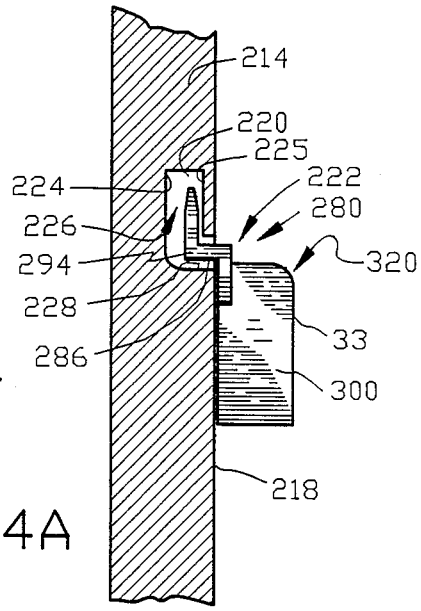
FIG. 5 is a partial sectional view taken along line 5—5 of FIG. 1.

FIG. 5 is a partial sectional view illustrating the reception of the hanger member 240 into the opening 222 of the L-shaped groove 220 formed in the slat board 214. The L-shaped receiving groove 220 includes an elongated opening formed in the slat board 214 in the shape of an "L" with a rearward wall 224, a floor 228, a forward wall 225 and an opening 222. The L-shaped groove 220 receives the third section 274,294 of and at least a portion of each second section 264,286 of each first 256 and second 280 tongue, respectively, when the hanger member 240 is in a working position 320. The supporting means 300 extends downwardly towards the bottom 215 of the slat board 214. The support groove in the slat board is a laterally elongated opening which extends first rearwardly from the face 218 of the slat board 214 and then upwardly 226 in a parallel or substantially parallel manner relative to the face of the slat board. The opening in the slat board thus defines a L-shaped receiving groove 220 when taking a cross-sectional view of the slat board as shown.

Figure 6:
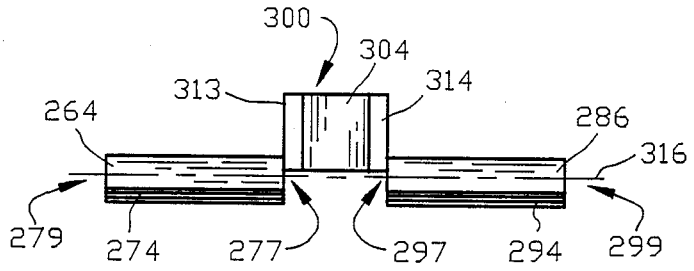
FIG. 6 is a top view of FIG. 3.

FIG. 6 is a top view of the hanger member 240 illustrating the first 313 and second 314 sidewalls and floor 304 of the supporting means 300. Each first 256 and second 280 tongue is positioned in the same plane 316.

Figure 7:
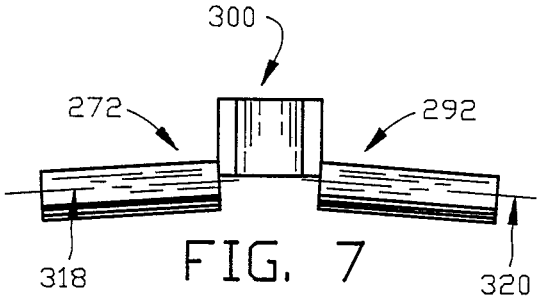
FIG. 7 is a top view of a further embodiment.

FIG. 7 is a top view of a further embodiment illustrating each first 256 and second 280 tongues being biased such that each first 256 and second 280 tongue is positioned in a different plane 318, 320, respectively. This provides a wobble free securement when the first 256 and the second 280 tongues are received into the L-shaped groove 220 of the slat board and enhances the stability of the hanger member and elongate post supported by the hanger member.

Figure 8:
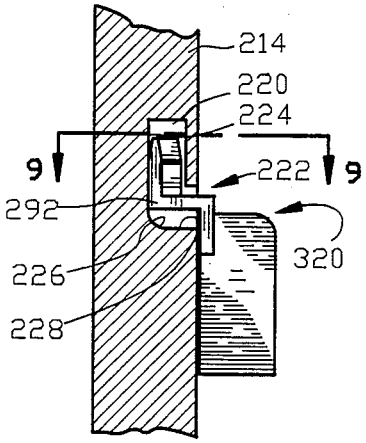
FIG. 8 is a partial sectional view taken along line 8—8 of FIG. 1.

FIG. 8 is a partial sectional view illustrating the reception of biased second 280 tongue when the hanger member 240 is in a working position 320. Preferably, the slat board 214 includes a plurality of support grooves with each groove being spaced parallel relative to an adjacent groove. In use the slat board is preferably positioned such that the support grooves are horizontal or substantially horizontal with the receiving groove oriented in a L-shape manner. The groove must extend laterally a sufficient length to receive both the first and second tongues of the hanger. Preferably, the elongated openings extend along the entire length of the slat board to enable the positioning the hanger anywhere along the length of the slat board.

Figure 9:
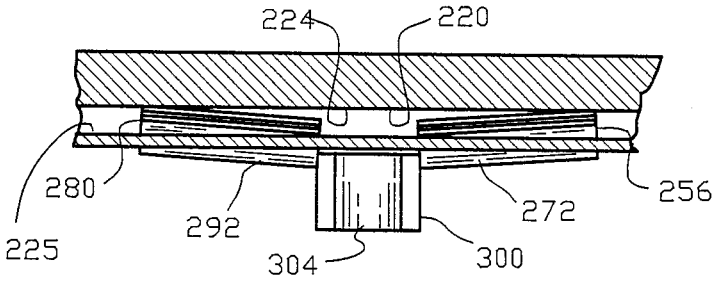
FIG. 9 is a sectional view taken along line 9—9 of FIG. 8.

FIG. 9 is a partial sectional view illustrating the hanger member 240 having the first 272 and second 292 biased tongues when received into the L-shaped receiving groove 220 of the slat board 214 to enhance the abutting engagement of the tongues 272,292 within the L-shaped receiving groove. This engagement stably secures the hanger member to the slat board. To remove the hanger from the slat board, the hanger, or more specifically, the supporting means is grasped and pivoted outwardly and slightly downwardly, as viewed in FIG. 1 to disengage the tongues from the openings 222 of the slat board 214.

Figure 10:
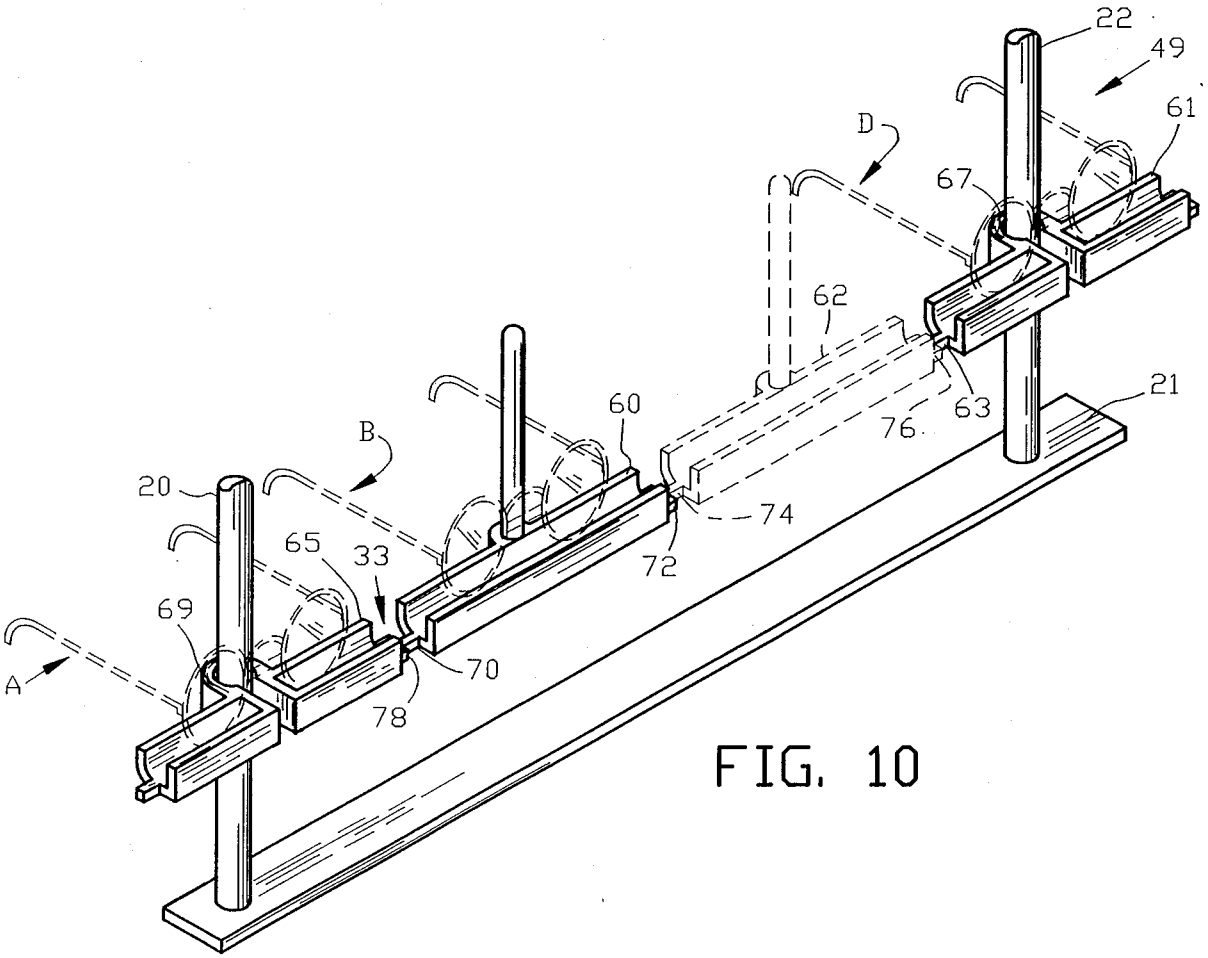
FIG. 10 is an isometric view of the article display of the invention.
Figure 11:
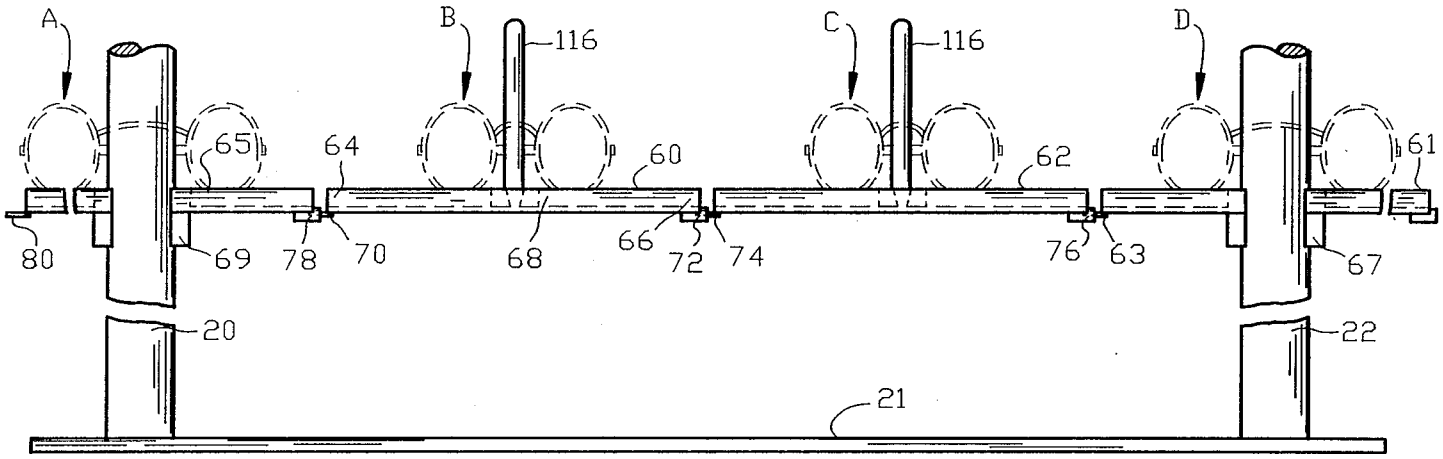
FIG. 11 is a front view of the embodiment of an article display of the invention illustrated at FIG. 10.

FIG. 10 is an isometric view of the article display of the invention. FIG. 10 illustrates a plurality of display trays 49 spanning the distance between first post 20 and second post 22. The display trays include horizontal member 61 releasably secured to second post 22 by grasping means 67 with the tenon 63 of horizontal member 61 releasably secured within the mortise 76 of second bridging display tray 62. The second bridging display tray 62 is shown in phantom to illustrate its removal from the article display upon the sale of the eyeglasses once positioned thereon for display. With the removal of tray 62, the article display is completely filled with articles on display. The tenon 74 of the second bridging display tray 62 is received by mortise 72 of the first bridging display tray 60 and the tenon 70 of the first bridging display tray 60 is releasably secured within the mortise 78 of horizontal member 65. The mating of tenon 70, 74 and 63 within mortise 78, 72 and 76, respectively, forms a mortise and tenon joint generally designated 33. Horizontal member 65 is releasingly gripped to supporting post 20 by grasping means 69. Positioned within horizontal member 61, horizontal member 65, and first bridging display tray 60 are eyeglasses A, D and B, respectively, FIG. 11 is a front view of the embodiment of an article display of the invention illustrated at FIG. 10. FIG. 11 illustrates a plurality of display trays 49 spanning the distance between first post 20 and second post 22. The display trays include horizontal member 61 releasably secured to second post 22 by grasping means 67 with the tenon 63 of horizontal member 61 releasably secured within the mortise 76 of the second bridging display tray 62. The second bridging display tray 62 is included in FIG. 11 to illustate complete spanning or bridging of the distance between supporting posts 20 and 22 by the plurality of display trays 51 prior to the sale of eyeglasses "C" from tray 62. The tenon 74 of the second bridging display tray 62 is received by mortise 72 of the first bridging display tray 60 and the tenon 70 of the first bridging display tray 60 is releasably secured within the mortise 78 of the horizontal member 65. Horizontal member 65 is releasingly gripped to supporting post 20 by grasping means 69.

Figure 12:
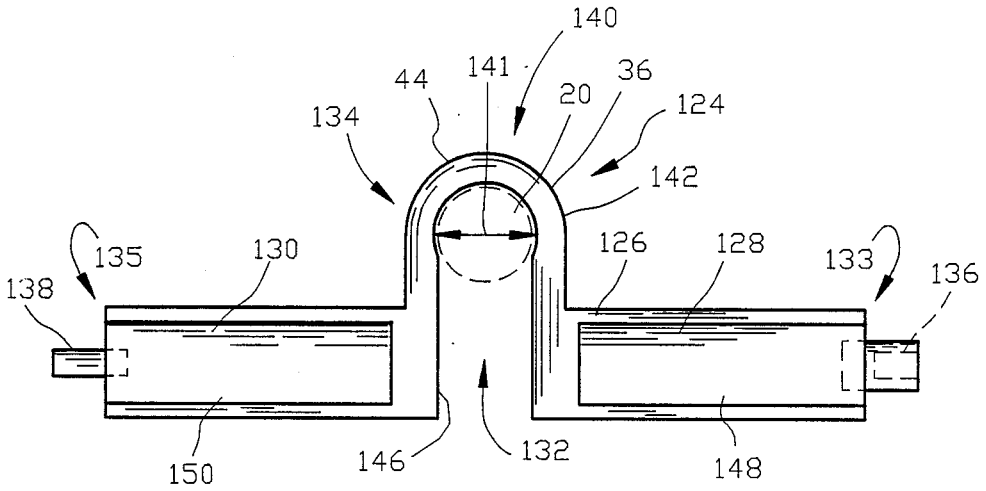
FIG. 12 is a top view of a horizontal member illustrating a mortise and tenon.

FIG. 12 is a top view of horizontal member generally designated 124. The description of horizontal member 126 describes other horizontal members such as horizontal members 24, 26, 61 and 65. A first 133 and a second 135 fastening means is integrally formed and positioned at the first end 128 and the second end 130 of the horizontal member 126, respectively. The integrally formed first 133 and the second 135 fastening means of the horizontal member 126 are, preferably, a mortise 136 and a tenon 138, respectively. FIG. 12 illustrates the first end 128 of horizontal member 126 having a mortise 136 and a tenon 138 located at second end 130 of horizontal member 126. The mortise 136 and the tenon 138 positioned at the first end 128 and second end 130 of the horizontal member 126, respectively, enables a releasable attachment and interconnection of one of the mortise 117A and tenon 117B of the bridging tray 108 to one of the 136 mortise and tenon 138 of the horizontal member 126 by forming a mortise and tenon joint 33 between one end 128,130 of the horizontal member 126 and one end 110,112 of the bridging tray 108 thereby enabling the removal of the bridging tray 108 as the final article displayed on the bridging tray is removed to enable the article display to remain filled with displayed articles, as see FIGS. 10 and 11. The intermediate portion 132 of horizontal member 126 defines a grasping means 134. The description of grasping means 134 of horizontal member 126 describes other grasping means such as grasping means 36, 46. Grasping means 134 comprises a semicircle portion 140 having two sidewalls 142 and 144 extending from the semicircle portion 140 to define an opening 146. First trough 148 and second trough 150 are axially spaced apart to permit the semicircle portion 140 to grippingly receive the supporting posts 20 illustrated in phantom lines, such that the first 148 and second 150 troughs of horizontal member 126 are positioned substantially entirely in front of the vertical supporting post 20 shown in phantom lines.

Figure 13:
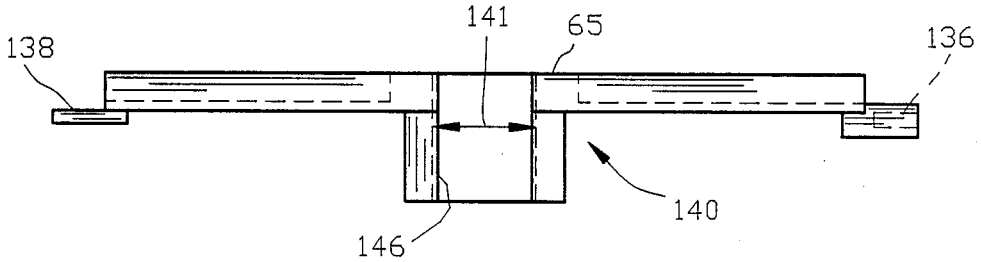
FIG. 13 is a front view of FIG. 12.

FIG. 13 illustrates a front view of the horizontal member 126 of FIG. 12. The inner diameter 141 of the semicircle portion 140 corresponds to the outer diameter of supporting post 20. Whereas, the distance between sidewalls 142 and 144 is slightly less than the inner diameter of semicircle portion 140 to enable the horizontal member to grip the supporting post in a stationary manner.

Figure 14:
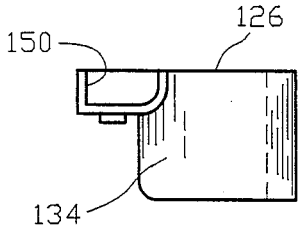
FIG. 14 is a side view of FIG. 13.

FIG. 14 is a left side view of the invention illustrated at FIG. 13 illustrating second trough 150 and tenon 138.

Figure 15:
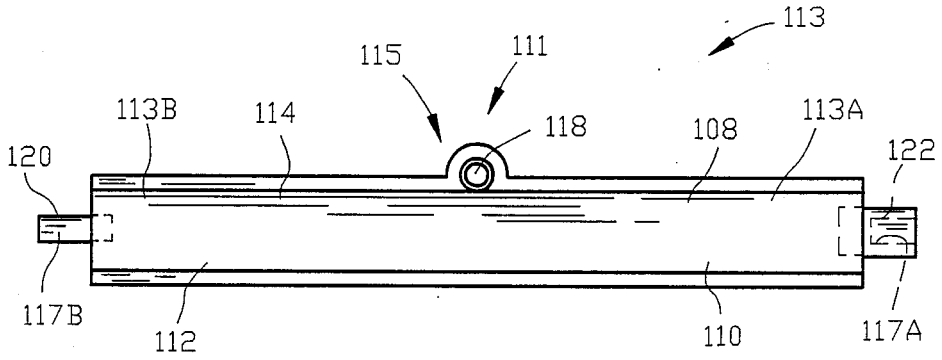
FIG. 15 is a top view of a bridging display tray of the invention.

FIG. 15 is a top view of a bridging member generally designated 111. The article displaying member 113 includes a first **113*a* and second 113*b* segments having a mortise 117*a* and tenon 117*b*, respectively, such that a mortise and tenon joint is formed as illustrated at FIG. 10. A more specific article displaying member is bridging display tray 108. The bridging tray 108 includes a first end 110 and a second end 112 with a trough 114 extending therebetween. The bridging tray 108 further includes an intermediate portion 115 positioned between the first end 110 and second end 112. An aperture 118 is formed at the intermediate portion 115 of bridging member 108. An elongated bar 116, not shown, having a first end 117 and a second end 119 with the first end 117 being slidably received into aperture 118. The positioning of the elongated bar 116 into aperture 118 enables the article, such as eyeglasses, to be positioned with trough 114 at an angle to permit enhanced display and complete visual examination. Located at the first end 110 of bridging tray 108 is mortise 122. In a like manner located at the second end 112 of bridging tray 108 is located tenon 120. Mortise 122 and tenon 120 cooperate with their mating counterparts in adjacent display trays such as horizontal member 65 and bridging display tray 60 to enable the structural spanning by the bridging trays of the space separating first post 20 and second post 22 as illustrated at FIG. 10**.

Figure 16:
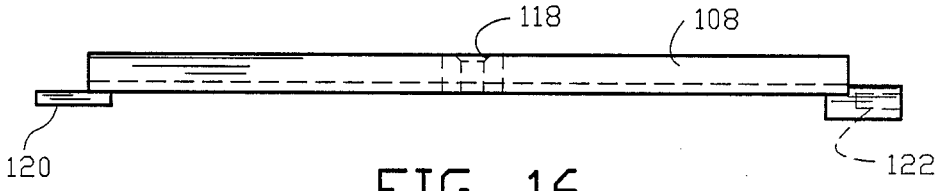
FIG. 16 is a front view of FIG. 15.

FIG. 16 is a front view of FIG. 15 which illustrates aperture 118 into which is received elongated bar 116, not shown. Also illustrated are tenon 120 and mortise 122 for inter-attaching trays having the mating counterparts to form a mortise and tenon joint as illustrated at FIG. 10.

Figure 17:
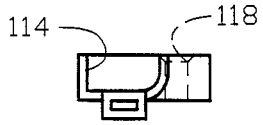
FIG. 17 is a side view of FIG. 16.

FIG. 17 is a side view of FIG. 16 which illustrates trough 114 which receives the article to be displayed and aperture 118 which receives elongated bar 116, not shown. Trough 114 and elongated bar 116 cooperate to position a pair of eyeglasses thereon.

Figure 18:
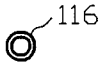
FIG. 18 is a front view of elongate rod for use with the bridging display tray of FIG. 15.
Figure 19:
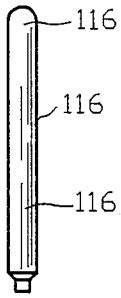
FIGS. 19 and 20 are a top and bottom view of FIG. 19, respectively.
Figure 20:
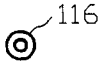

FIGS. 18, 19 and 20 illustrate elongated bar 116 with a top view of the elongated bar 116 illustrated at FIG. 18 and a bottom view of elongate bar 116 illustrated at FIG. 20 and a front view of elongate bar 116 illustrated at FIG. 19. Elongate bar includes a first end 117 and a second end 119 with the first end 117 being slidably received into aperture 118. When positioned into aperture 118, elongate bar functions as a "nose" to hold the eyeglasses in a position like that if positioned on a face of a glasses wearer.

Figure 21:
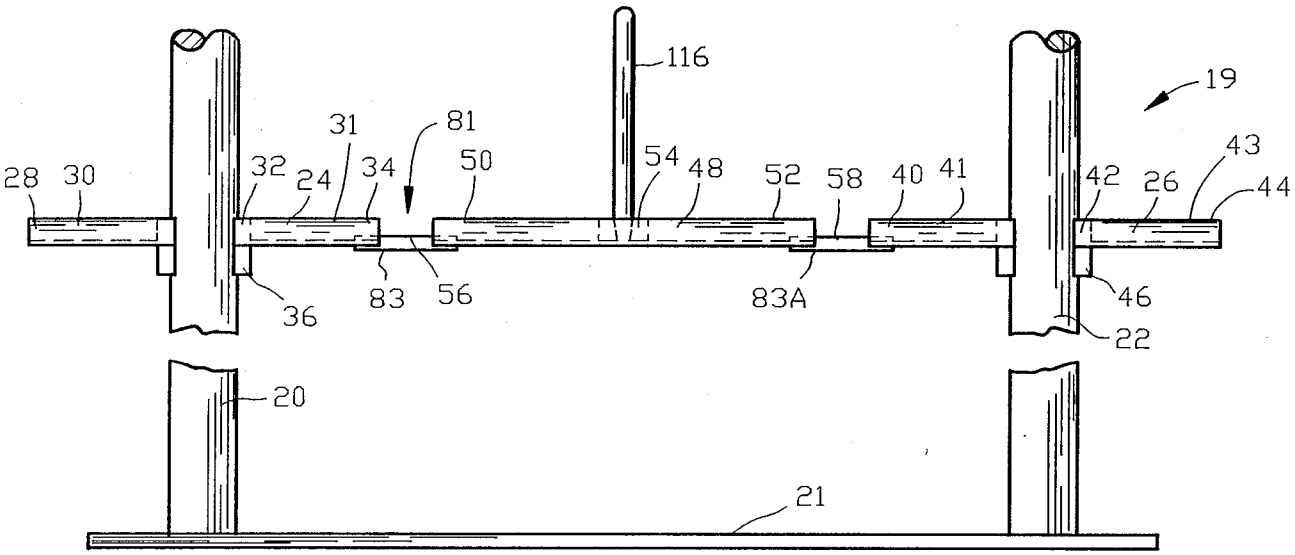
FIG. 21 is a front elevational view of an article display of the invention for displaying a plurality of articles.

FIG. 21 illustrates another embodiment of the article display of the invention 19 for displaying a plurality of articles thereon. In this embodiment, first post 20 and second supporting post 22 are secured to a base 21. First horizontal member 24 is releasingly attached to first post 20 by grasping means 36. In a like manner, second horizontal member 26 is releasably attached to second post 22 by grasping means 46. The first horizontal member 24 includes a first portion 28, a second portion 34 and an intermediate portion 32. The first portion 28 defines a first trough 30 and the second portion 34 defines a second trough 31. In like manner, the second horizontal member 26 includes a first portion 40, a second portion 44 and an intermediate portion 42. The first portion 40 defines a first trough 41 and the second portion 44 defines a second trough 43. The first 30 and 41 troughs and second 31 and 43 troughs of the first 24 and second 26 horizontal members cooperate with first 20 and the second 22 post to position the eyeglasses (not shown) on the first 24 and second 26 horizontal members. Positioned between the first post 20 and second post 22 is bridging member 48. Bridging member 48, described in greater detail above, includes a first end section 50, a second end section 52 and a mid section 54. A first fastening means 56 releasably interconnects the first end section 50 of bridging member 48 to the second portion 34 of the first horizontal member 24. In a like manner, second fastening means 58 releasably interconnects the second end second 52 of bridging member 48 to the first portion 40 of the second horizontal member 26. First fastening means, generally designated as 56 and second fastening means, generally designated as 58 interconnect the first and second horizontal members 24 and 26 to the bridging member 48. More specifically, the fastening means include interlinking rod generally designated 81, described in detail below. As illustrated, interlinking rod 83 and 85 interconnect the displaying trays to span the distance between supporting posts 20 and 22. The fastening means further includes the tenon and mortise joint.

The intermediate portion 42 of bridging member 48 further includes an elongate bar 116 which cooperates with the trough 47 of bridging member 48 to position the eyeglasses (not shown) on the bridging member 48. The article display of the invention permits an article to be displayed, such as eyeglasses, at each horizontal member 24 and 26 and at the bridging member 48. This enables an article displaying member or display tray to be removed from the article display when the article, such as eyeglasses, are removed from the article display there maintaining the article display in a filled condition. Likewise, this enables the addition of one or more article display members or trays as one or more articles to be displayed become available thereby providing an additional display tray in a previously filled article display.

Figure 22:
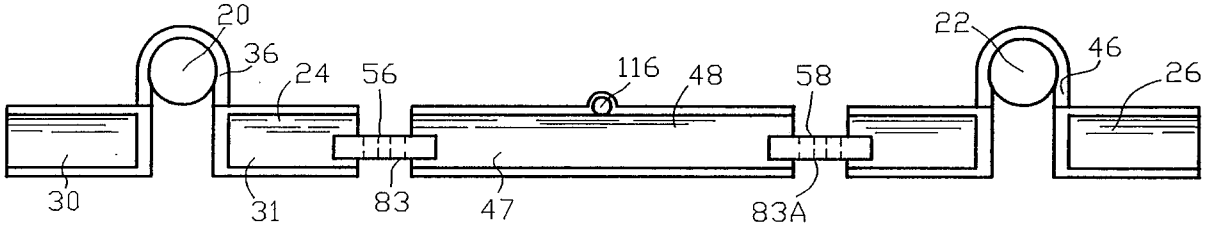
FIG. 22 is a top view of FIG. 21.

FIG. 22 is a top view of FIG. 21 absent base 21. FIG. 22 illustrates first horizontal member 24, bridging member 48 and second horizontal member 26 spanning the distance between first post 20 and first post 22 as enabled by interlinking rods 83 and 83*a*.

Figure 25:
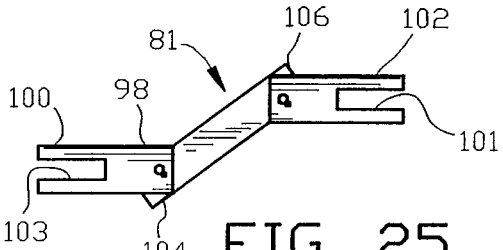
FIG. 25 is a front view of a hinged interlinking rod.
Figure 24:
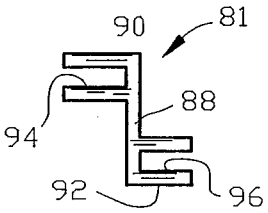
FIG. 24 is a front view of another embodiment of the interlinking rod.
Figure 23:
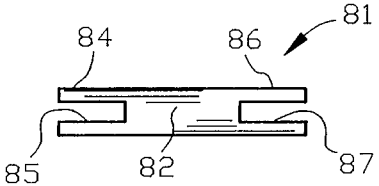
FIG. 23 is a front view of an embodiment of an interlinking rod illustrated in use in FIG. 12.

FIGS. 23, 24 and 25 illustrate different embodiments of the interlinking rod generally designated 81. Interlinking rod 81 is used to interconnect display trays which do not have integrally formed connecting means such as those of bridging display tray 62 at FIG. 11, for example. However, interlinking rod 81 may be used with trays with integrally formed connecting means, if desired. FIG. 13 illustrates a first embodiment of the interlinking rod 82. Interlinking rod 82 includes a first end 84 and a second end 86. An opening 85 is formed in the first end 84 of interlinking rod 82 to releasably receive an end portion of a horizontal member to interconnect a first end section of a bridging member 48 to an end portion of a horizontal member or to an end section of a bridging member. FIG. 21 illustrates interlinking rod 82 interconnecting horizontal members 24 and 26 with bridging member 48.

FIG. 24 illustrates an off-set embodiment 88 of interlinking rod 81. The off-set interlinking rod 88 includes first end 90 and second end 92. An opening 94 is formed at the first end 90 of the off-set interlinking rod 88. In a like manner, an opening 96 is formed at the second end 92 of off-set interlinking rod 88. Openings 94 and 96 releasably secure one article display tray a portion of which is received in opening 94 to an adjacent article display tray a portion of which is received in opening 96.

FIG. 25 illustrates a third embodiment 98 of interlinking rod 81. Hinged interlinking rod 98 includes a first end 100 and a second end 102. A first hinge 104 is positioned proximate the first end 100 of the hinged interlinking rod 98. A second hinge 106 is positioned proximate the second end 102 of hinged interlinking rod 98. Rotation about hinges 104 and 106 is reduced in order to enable the positioning of an article display tray received in opening 103 to retain its position relative the article display tray received within opening 101 notwithstanding the weight of the article displayed.

Figure 26:
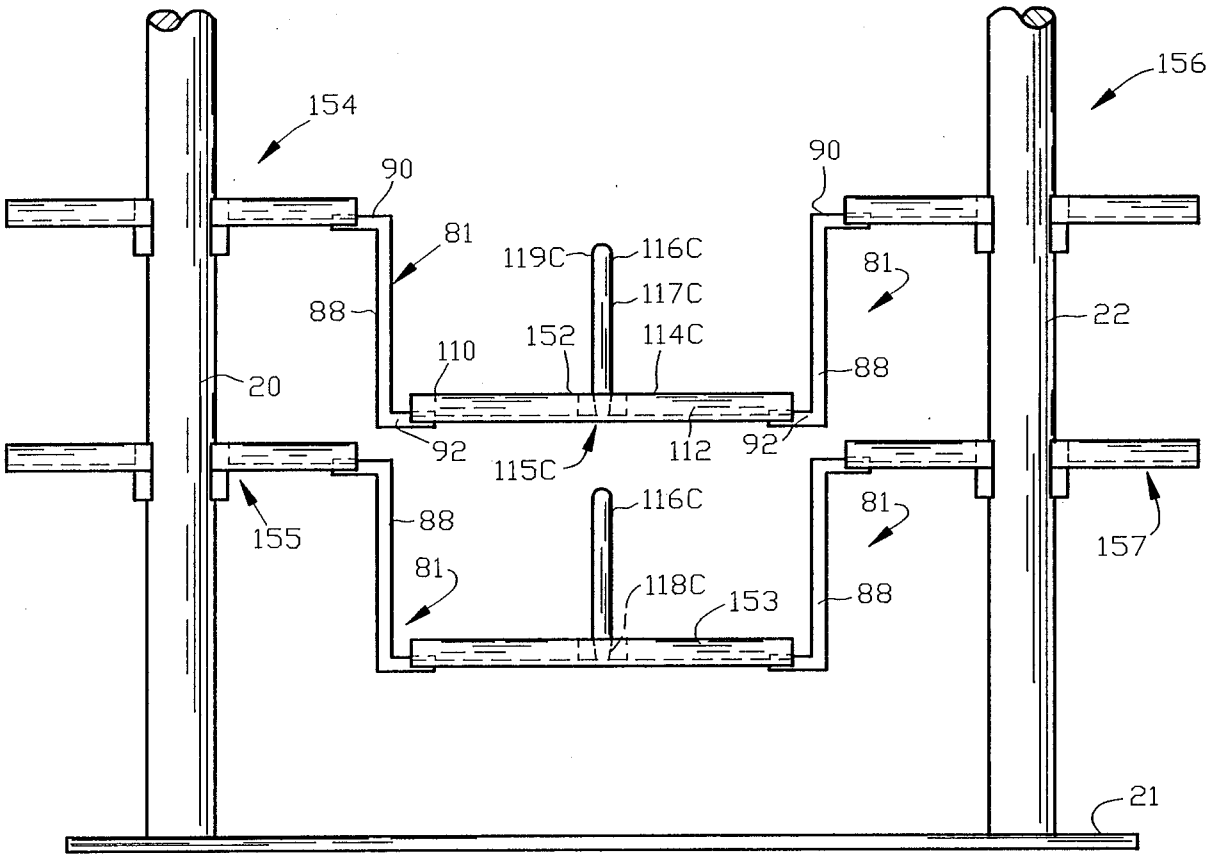
FIG. 26 is a front view of another embodiment of the article display of the invention.

FIG. 26 is a front view of another embodiment of the article display of the invention. FIG. 26 illustrates the use of off-set interlinking rod 88 to enable the spanning of a first post 20 and a second post 22 by article display trays which do not have integrally formed connecting means. Article display member 113 is described by bridging tray 108 at FIG. 15 except that bridging tray 152 does not include mortise 122 and tenon 120 of bridging tray 108. The bridging trays 152 and 153 each include a first end 110C and a second end 112C with a trough 114C extending therebetween. The bridging trays 152 and 153 further include an intermediate portion 115C positioned between the first end 110C and second end 112C. An aperture 118C is formed at the intermediate portion 115C of each bridging member 152 and 153. An elongated bar 116C having a first end 117C and a second end 119C with the first end 117C being slidably received into aperture 118C. The positioning of the elongated bar 116C into aperture 118C enables the article, such as eyeglasses, to be positioned within trough 114C at an angle to permit enhanced display and complete visual examination. The spanning of the distance between supporting posts 20 and 22 depends on interlinking rod 88 to interconnect the bridging tray 152 with horizontal members 154 and 156. In like manner, the spanning of the distance of the distance between supporting posts 20 and 22 by horizontal member 155, bridging tray 153 and horizontal member 157 depends on interlinking rod 88 to enable interconnection therebetween.

The opening, such as 85, 87, 94 and 96 of interlinking rod 81 which grasp the display inserted therein permit pivoting of the grasped display tray in a substantially horizontal plane. This enables, for example a circular article display comprising for example four supporting posts and a sufficient number of horizontal members and bridging members to support and close the circle. Opening 101 and 103 permit even greater pivoting of the display tray.

The bridging member, article display member or display tray is composed of a resilient plastic material. Preferably, the plastic material is a polycarbonate resin. Most preferably the resin is transparent.

Preferably, the article display member is such that the trough is open at the ends farthest from the supporting post.

The grasping means of the article display member is such that the entry portion of the opening for receiving the supporting post is positioned on the same side or the opposite side of the tray as the first linear edge. Preferably, the grasping means of the article display member is such that the entry portion of the opening for receiving the supporting post is positioned on the same side of the tray as the first linear edge.

While certain features of this invention have been described in detail with respect to various embodiments thereof, it will of course be apparent that other modifications can be made within the spirit and scope of this invention, and it is not intended to limit the invention to the exact details insofar as they are defined in the following claims.

The present disclosure includes that contained in the appended claims as well a that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. An article display tray for cooperation with a base and a supporting post attached to the base with the post extending vertically relative to the base and a bridging display tray including a first end and a second end with a trough extending therebetween for the positioning of at least one article to be displayed thereon and a first and a second attachment means positioned at the first end and the second end of the bridging display tray wherein the first and second attachment means are a mortise and a tenon, respectively, comprising:

a horizontal member including a first portion, a second portion and an intermediate portion;

each of said first and second portions of said horizontal member defines a first and second trough, respectively, to enable in use the positioning of the article to be displayed thereon;

said intermediate portion of said horizontal member defines a grasping means for releasingly gripping in use the supporting post to enable said horizontal member to be positioned along the vertical length of the supporting post;

said first and second portions of said horizontal member being axially spaced apart to provide an opening to permit said grasping means of said horizontal member to grippingly receive said supporting post;

said grasping means comprises a semicircle portion having two sidewalls leading from said semicircle portion thereby defining said opening formed by said axially spaced apart said first and second portion of said horizontal member to permit said semicircle portion to grippingly receive said supporting post such that in use said first and said second troughs of said horizontal member are positioned substantially entirely in front of the supporting post;

said horizontal member including a first end and a second end; and a mortise and a tenon positioned at said first end and said second end of said horizontal member, respectively, for enabling in use the releasable attachment and interconnection of one of the mortise and tenon of the bridging tray to one of said mortise and said tenon of said horizontal member by forming a mortise and tenon joint between one end of said horizontal member and one end of the bridging display tray thereby enabling the removal of the bridging display tray as the final article displayed on the bridging display tray is removed to enable the article display to remain filled with displayed articles.

2. An article display tray comprising:

a horizontal member including a first portion, a second portion and an intermediate portion;

each of said first and second portions of said horizontal member defines a first and second trough, respectively, to enable in use the positioning of an article to be displayed thereon;

said intermediate portion of said horizontal member defines a grasping means for releasingly gripping in use a supporting post to enable said horizontal member to be positioned along the vertical length of said supporting post;

said first and second portions of said horizontal member being axially spaced apart to provide an opening to permit said grasping means of said horizontal member to grippingly receive said supporting post;

said grasping means comprises a semicircle portion having two sidewalls leading from said semicircle portion thereby defining said opening formed by said axially spaced apart said first and second portion of said horizontal member to permit said semicircle portion to grippingly receive said supporting post such that in use said first and said second troughs of said horizontal member are positioned substantially entirely in front of the supporting post;

said horizontal member including a first end and a second end; and a mortise and a tenon positioned at said first end and said second end of said horizontal member, respectively, for enabling in use a releasable attachment and interconnection of said horizontal member to a bridging display tray having a first and a second end with a mortise and a tenon positioned at the first end and the second end, respectively, by forming a mortise and tenon joint between one end of said horizontal member and one end of said bridging display tray to enable the removal of the bridging tray as the final article displayed on said bridging display tray is removed to enable the article display to remain filled with displayed articles.

3. An article display for displaying a plurality of articles comprising:

a slat board having a L-shaped receiving groove;

an elongate post having a first end and a second end;

a plurality of display trays for displaying articles thereon wherein each display tray of said plurality of display trays is secured to said elongate post such that said elongate post supports each display tray of said plurality of display trays secured to said elongate post;

a hanger member including a first portion, a second portion and an intermediate portion;

each of said first and second portions of said hanger member defines a first tongue and a second tongue, respectively;

said intermediate portion of said hanger member defines a supporting means for securely gripping said elongate post;

said first and second tongues of said hanger member being spaced apart to provide an opening to permit said supporting means of said hanger member to releasing grip in use said elongate post to enable the positioning of at least one display tray along the length of said elongate post;

said supporting means comprises a semicircle portion having two sidewalls leading from said semicircle portion thereby defining said opening formed by said first tongue being spaced apart from said second tongue of said hanger member to permit said semicircle portion in use to grippingly receive said elongate post thereby supporting said elongate post; and each said tongue being adapted to be releasably secured within said L-shaped receiving groove of said slat board by means of engagement with said L-shaped receiving groove such that each said tongue securely supports said hanger member on said slat board to enable said elongate post to be securely supported by said supporting means of said hanger member and to further enable said elongate post to securely support each display tray of said plurality of display trays and at least one article for display positioned on each said display tray of said plurality of display trays.

4. The article display of claim 3 wherein said slat board is mounted in a plane; and said supporting means is positioned to lie in a plane common to said plane of said slat board such that in use said elongate post extends outwardly relative to said plane of said slat board when positioned in said supporting means.

5. The article display of claim 3 wherein said slat board is mounted in a plane; and said elongate post further includes a bend positioned between said first end and said second end of said elongate post such that in use said bend of said elongate post results in a change of direction of said elongate post relative to said plane of said slat board to enable the articles to be displayed at an inclined angle.

* * * * *